US009045945B2

(12) United States Patent
Purcell

(10) Patent No.: US 9,045,945 B2
(45) Date of Patent: Jun. 2, 2015

(54) ATTACHMENT FOR PERCUSSION DRILL TOOLS

(75) Inventor: Joseph Purcell, Ennis (IE)

(73) Assignee: MINCON INTERNATIONAL, Shannon, Co. Clare (IE)

( * ) Notice: Subject to any disclaimer, the term of this patent is extended or adjusted under 35 U.S.C. 154(b) by 303 days.

(21) Appl. No.: 13/814,746

(22) PCT Filed: Aug. 10, 2011

(86) PCT No.: PCT/EP2011/063778

§ 371 (c)(1),
(2), (4) Date: Feb. 7, 2013

(87) PCT Pub. No.: WO2012/020058

PCT Pub. Date: Feb. 16, 2012

(65) Prior Publication Data

US 2013/0133952 A1 May 30, 2013

(30) Foreign Application Priority Data

Aug. 12, 2010 (IE) ..... S2010/0502

(51) Int. Cl.

| | |
|---|---|
| ***E21B 4/14*** | (2006.01) |
| ***E21B 10/38*** | (2006.01) |
| ***E21B 21/10*** | (2006.01) |
| ***E21B 31/03*** | (2006.01) |

(52) U.S. Cl.

CPC ..... *E21B 4/14* (2013.01); *E21B 21/103* (2013.01); *E21B 10/38* (2013.01); *E21B 31/03* (2013.01)

(58) Field of Classification Search

CPC ..... E21B 4/14; E21B 31/03; E21B 1/00; E21B 34/12; E21B 10/38; E21B 21/103

See application file for complete search history.

(56) References Cited

U.S. PATENT DOCUMENTS

| | | | | | |
|---|---|---|---|---|---|
| 3,595,323 | A | * | 7/1971 | Schindler et al. | 173/126 |
| 4,030,554 | A | * | 6/1977 | Kammerer et al. | 173/17 |
| 4,079,793 | A | * | 3/1978 | Mosely et al. | 173/80 |

(Continued)

FOREIGN PATENT DOCUMENTS

| | | | | | |
|---|---|---|---|---|---|
| GB | 2272923 | A | * | 6/1994 | E21B 21/10 |
| WO | WO 01/81704 | A1 | | 11/2001 | E21B 4/14 |
| WO | WO 2007/034462 | A1 | | 3/2007 | E21B 7/28 |

OTHER PUBLICATIONS

Int'l Search Report from corresponding PCT/EP2011/063778 (Form PCT/ISA/210); 3 pages.

*Primary Examiner* — Jennifer H Gay

(74) *Attorney, Agent, or Firm* — Kusner & Jaffe

(57) ABSTRACT

An attachment for a fluid-operated percussion drill tool, the drill tool having a backhead assembly for attachment to a drill rod. The attachment comprises a shaft attachable to the backhead assembly, wherein the shaft comprises a central bore in fluid communication with a pressure bore of the drill rod. The attachment further comprises a sleeve co-axially slidably mounted on the shaft, the sleeve comprising an outer shoulder at a rear end thereof, and at least one rearwardly-directed exhaust passage. Pressurised air supplied from the central bore of the shaft to urge the sleeve rearwards into a closed position in which air is prevented from exhausting through the exhaust passage. When a restriction is encountered at the shoulder, the sleeve moves forward to an open position in which air is permitted to exhaust through the exhaust passage adjacent to the restriction.

19 Claims, 6 Drawing Sheets

(56) References Cited

U.S. PATENT DOCUMENTS

| | | | | | |
|---|---|---|---|---|---|
| 4,694,911 | A * | 9/1987 | Kennedy | 173/62 |
| 4,722,403 | A * | 2/1988 | Kostylev et al. | 175/296 |
| 4,726,429 | A * | 2/1988 | Kennedy | 173/62 |
| 4,974,690 | A * | 12/1990 | Flynn | 175/317 |
| 5,056,609 | A | 10/1991 | Rear | 175/296 |
| 5,119,891 | A | 6/1992 | Flynn | 175/317 |
| 2013/0098635 | A1 * | 4/2013 | Gette | 166/386 |
| 2013/0133952 | A1 * | 5/2013 | Purcell | 175/296 |

* cited by examiner

SECTION X-X

ATTACHMENT FOR PERCUSSION DRILL TOOLS

FIELD OF THE INVENTION

The present invention relates to an attachment for a fluid-operated percussion drill tool. The invention is particularly concerned with an attachment that may be used to back-hammer through a restriction in a drilled hole.

BACKGROUND TO THE INVENTION

A typical down-the-hole hammer comprises an external cylinder or outer wear sleeve, within which is mounted an inner cylinder, this in turn engaging with a backhead assembly. The backhead assembly is connected to source of compressed fluid via a drill rod. A sliding reciprocating piston co-operates with the inner cylinder and backhead assembly such that when compressed air is supplied through the backhead assembly, the piston acts with percussive effect on a drill bit retained within a chuck on the outer wear sleeve.

In some drilling applications, the drilled hole may cave in, and debris from the walls of the hole may fall down on the hammer. Such debris often lodges at the connection between the backhead and the drill rod, because the drill rod diameter is typically smaller than the diameter of the hammer and causes a restriction which impedes withdrawal of the hammer from the drilled hole. When this happens, the hammer is pulled back against the restriction. The hammer must be pulled with sufficient force to pull it past the restriction. However, where the restriction is closely packed, it may not be possible to pull the hammer through the restriction and in such cases, the hammer may be lost in the drilled hole.

In prior art systems, a back hammer, such as that produced by PG Drilling Equipment USA LLC, may be installed in the drill string above the drilled hole when required. There are a number of disadvantages associated with such a system. The first is that the back hammer is attached in the drill string at the joint nearest to the restriction. The back hammer is therefore positioned above the restriction and simply shakes the drill rod in an attempt to free it from the restriction. A further disadvantage is that the system is always on, that is, once installed, the back hammer operates regardless of whether a restriction is encountered or not.

Another prior art system is described in U.S. Pat. No. 5,119,891 which provides an adaptor for drilling strings, the adaptor having a controllable air passage. The adaptor comprises a body mountable on the lower end of a drill string and a sleeve rotatably mounted on the body and longitudinally moveable relative thereto. In normal drilling operation, pressurized air from a central pressure line of the drill string is directed via a central bore in the body to a first chamber defined by the body and the sleeve and through to a second chamber defined by the body and the sleeve and to the air intake of the hammer or drill bit. When the adaptor is to be used to clear a restriction above the hammer, the rotation of the drill string is stopped and the sleeve moves down relative to the body, such that the pressurized air can exhaust through exhaust passages above the sleeve to clear the debris. The sleeve may also be provided with teeth at an upper end thereof and the drill string may be rotated to enable the teeth to cut through the obstruction in the drill hole.

The primary disadvantage of this system is that, once the system is opened to allow air to exhaust through the restriction, it cannot be closed unless the hammer is placed back on the hole bottom or there is sufficient friction with the hole wall to encourage the system to close when rotating in the correct direction. Air thus continues to flush above the sleeve even after the restriction has been cleared. A further disadvantage is that the primary mechanism for removal of the restriction is the air flushed from the hammer. In certain cases this may not be sufficient to clear debris from a drilled hole to allow the hammer to be withdrawn. Although cutting teeth are also provided, again, these may not be sufficient to clear the restriction. Yet another disadvantage is that the helical splines are difficult to manufacture.

It is therefore desirable to provide a system which allows a percussion drill tool to be withdrawn from a drilled hole where a restriction has occurred while avoiding many of the disadvantages of prior art systems. In particular, it is desirable to provide a system for back hammering through a restriction which is operable only when a restriction is encountered. It is also desirable to provide a system which closes to prevent flushing once the restriction is cleared.

SUMMARY OF THE INVENTION

According to an aspect of the present invention, there is provided an attachment for a fluid-operated percussion drill tool, the drill tool having a backhead assembly for attachment to a drill rod, comprising:

- a shaft attachable to the backhead assembly, wherein the shaft comprises a central bore in fluid communication with a pressure bore of the drill rod; and
- a sleeve co-axially slidably mounted on the shaft, the sleeve comprising an outer shoulder at a rear end thereof; and
- at least one rearwardly-directed exhaust passage;
- such that pressurised air is supplied from the central bore of the shaft to urge the sleeve rearwards into a closed position in which air is prevented from exhausting through the exhaust passage; and
- when a restriction is encountered at the shoulder, the sleeve moves forward to an open position in which air is permitted to exhaust through the exhaust passage adjacent the restriction.

The terms “rear” and “rearwardly” as used herein are intended to indicate a direction opposite to the normal drilling direction of the drill tool. For example, where the drill tool is a down-the-hole hammer, the rearward direction is an upward direction. Conversely, the “forward” as used herein is intended to indicate a direction which is the same as the normal drilling direction of the drill tool. Where the drill tool is a down-the-hole hammer, the forward direction is an downward direction.

An advantage of the present invention is that, because the sleeve is urged into the closed position by the pressurised air supplied from the shaft, the back hammer attachment operates only when a restriction is encountered at the outer shoulder. Under normal operation conditions, the sleeve remains in the closed position and little or no air is exhausted at the sleeve. When a restriction is encountered, the sleeve moves forward against the air pressure allowing air to flush through the exhaust passage to clear the restriction. In this open position, air may be flushed at a rear end of the sleeve. Once the restriction has been cleared, the air pressure acting on the sleeve urges the sleeve back to the closed position. Thus, air is only flushed through the exhaust passage when a restriction is to be cleared, ensuring that the air flow to the drill tool is not compromised.

In normal operation, the sleeve is biased towards the closed end position by pressure within the central bore and when a restriction is encountered, the biasing is overcome to force the sleeve into the open flushing position in which air is permitted to exhaust through the exhaust passage adjacent the restriction.

According to a preferred embodiment, the sleeve further comprises an inner pressure face and pressurised air is supplied from the central bore of the shaft to act on the inner pressure face to urge the sleeve into the closed position. A chamber may be defined between the shaft and the sleeve, wherein the inner pressure face defines a rear end of the chamber. Suitably, the inner pressure face is forward-facing. The chamber may be in selective fluid communication with the central bore of the shaft.

The sleeve may be urged rearwards by way of the pressurised air acting directly or indirectly on the inner pressure face.

In an embodiment, the attachment further comprises:

a piston, slidably mounted on the central shaft and arranged for reciprocal movement within the chamber to impart a percussive force to the inner pressure face of the sleeve, wherein the percussive force is in a rearward direction, that is, in the opposition direction to the normal percussive force imparted by the tool.

An advantage of this arrangement is that a percussive force applied to the inner pressure face of the sleeve causes the outer shoulder of the sleeve to hammer through the restriction. Air is also flushed through the exhaust passage to assist in clearing the restriction. A further advantage of the present invention is that the sleeve is maintained in the closed position by air pressure until a restriction is encountered. This means that air is not flushed upwards through the drilled hole unless necessary due to a restriction, and the air flow to the drill tool is not compromised.

Ideally, the piston is arranged in the chamber such that pressurised air supplied from the central bore acts on the piston to urge the piston against the inner pressure face of the sleeve.

The piston may comprise a plurality of ports therethrough and when the sleeve moves to the open position, air supplied from the central bore flows through at least one port in the piston to cause the reciprocal movement of the piston within the chamber. Preferably, the piston comprises a first plurality of ports and a second plurality of ports therethrough and when the sleeve moves to the open position, the first and second pluralities of ports are alternately pressurized and exhausted to cause the reciprocal movement of the piston within the chamber.

The attachment may further comprise:

at least one air supply port in the shaft, the air supply port connecting the central bore with the chamber.

The attachment may further comprise:

at least one exhaust port in the shaft;

such that when the sleeve moves to the open position air is permitted to exhaust through the exhaust port and the exhaust passage.

The exhaust passage may be provided in the sleeve and may connect the central bore with a lower end of the exhaust passage when the sleeve is in the open position to permit air to exhaust through the exhaust port and the exhaust passage. This arrangement may be used in embodiments where no piston is included.

The exhaust passage may be provided between the sleeve and the shaft and the exhaust port may connect the chamber with the exhaust passage when the sleeve is in the open position to permit air to exhaust through the exhaust port and the exhaust passage. This arrangement may be used in embodiments where a piston is arranged in the chamber.

The shaft may be screw-threadably attachable at a lower end thereof to the back head assembly of the drill tool.

The attachment may further comprise a locking sub screw-threadably attached to the shaft at an upper end thereof, wherein the locking sub is attachable at an upper end thereof to a drill rod. In the closed position, an upper end of the sleeve may be seated against a lower end of the locking sub.

The attachment may further comprise a splined coupling between the shaft and the sleeve, such that the sleeve is prevented from rotating relative to the shaft.

The attachment of the present invention may be used with a percussion drill tool, such as a down-the-hole hammer comprising a backhead assembly. The attachment is attached at a forward end thereof to the backhead assembly. In a preferred embodiment, a front part of the shaft is internally screw-threaded for attachment to the backhead assembly.

The attachment may also be used with a percussion hammer for enlarging drilled holes, that is, a back reamer, comprising a backhead locking member. One such hammer is described in International Patent Application Publication No. WO2007/034462 of the present applicant. The attachment is attached at a forward end thereof to the backhead locking member of the back reamer. A front part of the shaft may be internally screw-threaded for attachment to the backhead locking member.

BRIEF DESCRIPTION OF THE DRAWINGS

Embodiments of an attachment for a percussion drill tool will now be described with reference to the accompanying drawings, wherein.

DETAILED DESCRIPTION OF THE DRAWINGS

Figures 1, 2, 3:
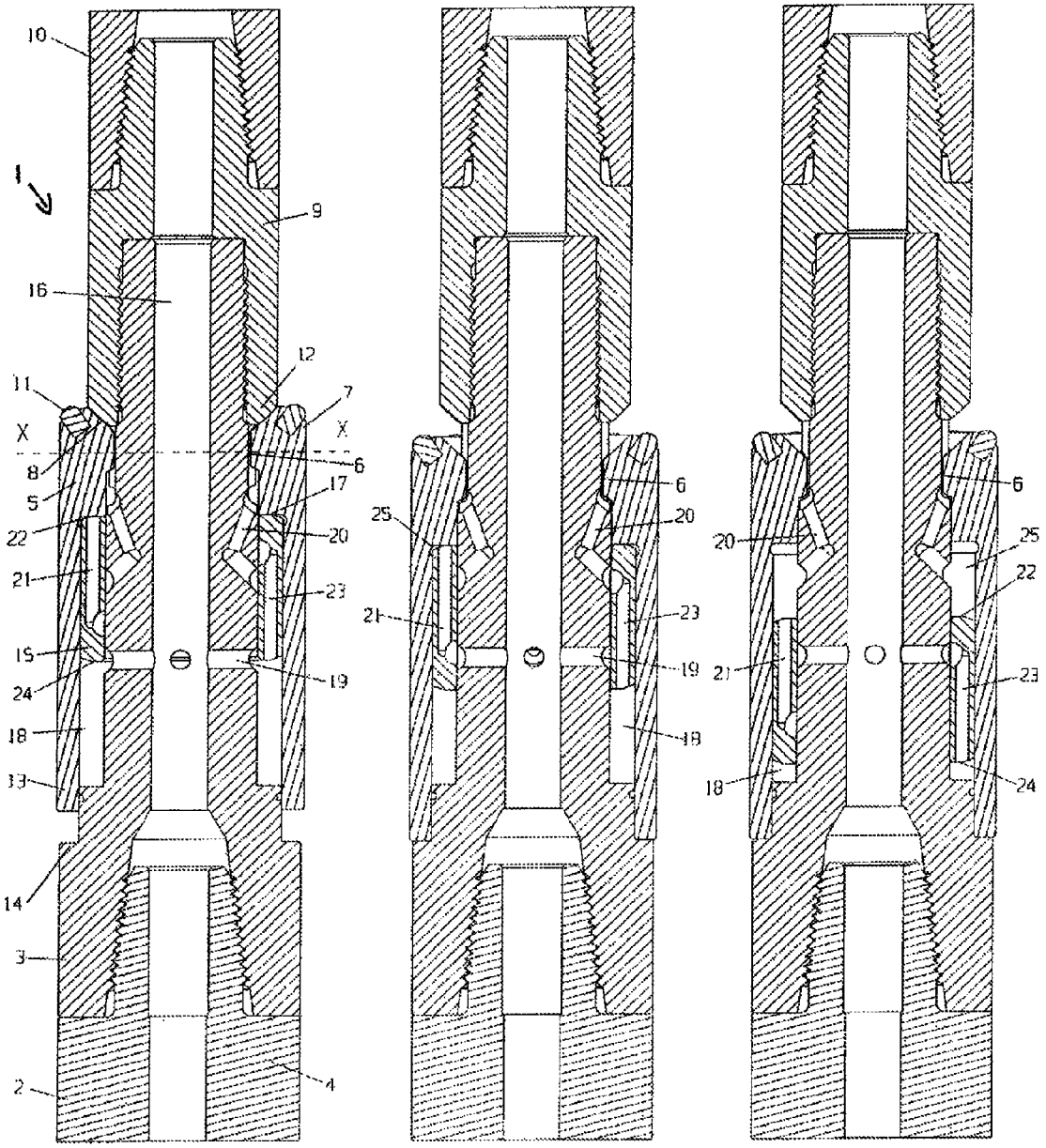
FIG. 1 is a sectional side elevation of an attachment according to a first embodiment of the present invention on a down-the-hole hammer, showing the positions of the sleeve and piston when no restriction is present.
FIG. 2 is a sectional side elevation of the attachment of FIG. 1, showing the piston in the strike position.
FIG. 3 is a sectional side elevation of the attachment of FIG. 1, showing the piston at top of stroke.
Figure 4:
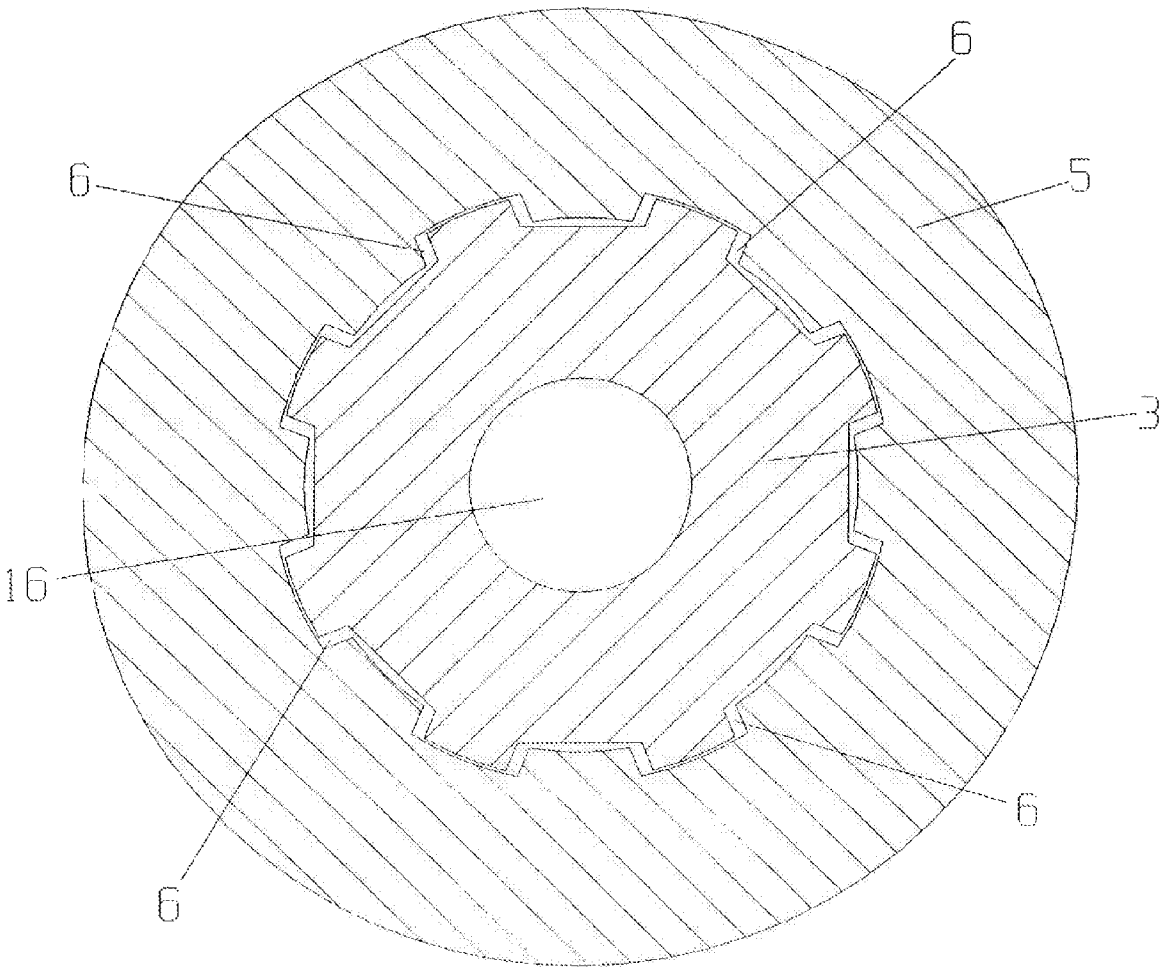
FIG. 4 is a cross-sectional view of the attachment of FIG. 1, taken along line X-X.
Figure 5:
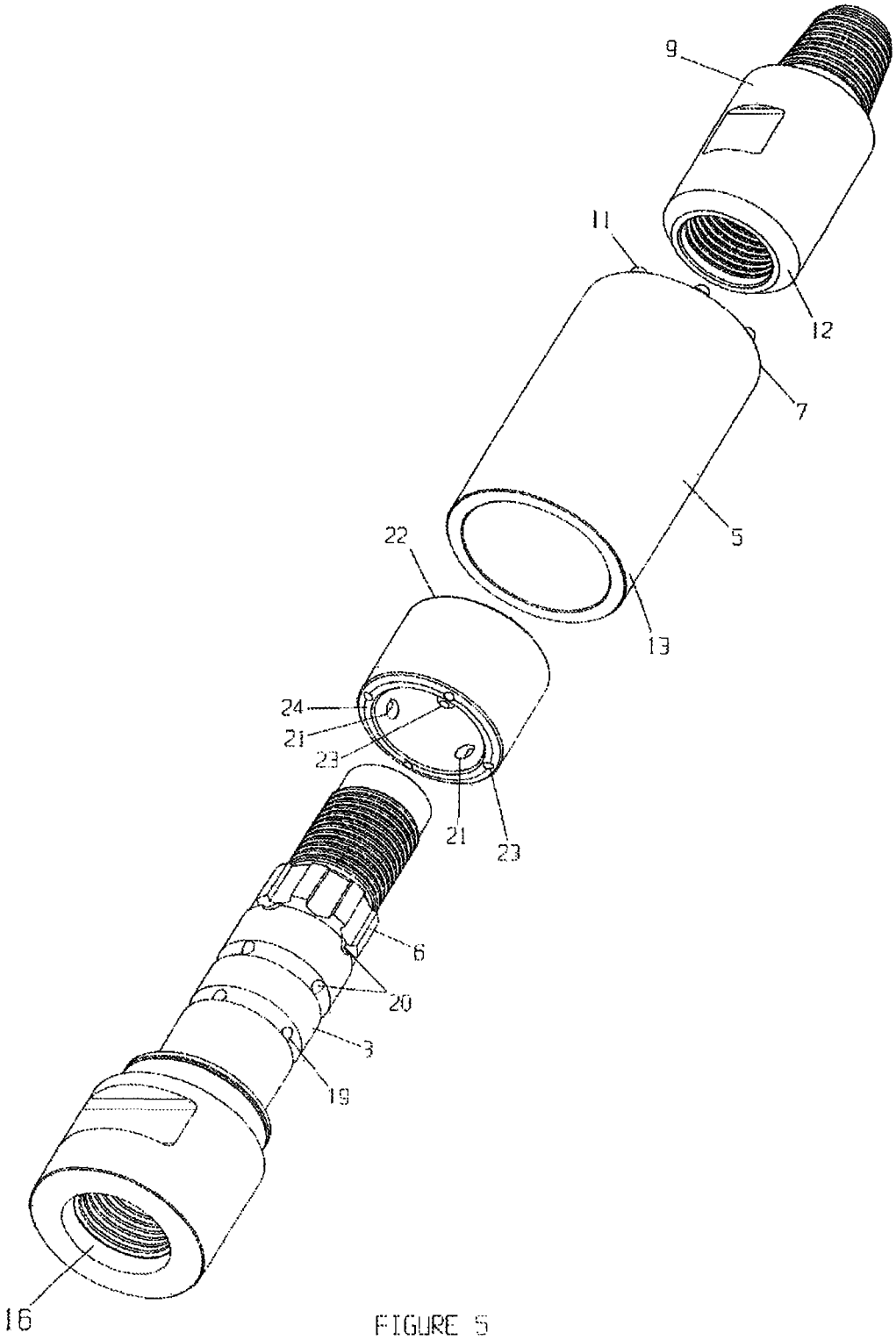
FIG. 5 is an exploded perspective view of the attachment of FIG. 1.

Referring to FIGS. 1 to 5, a first embodiment of an attachment 1 for a percussion drill tool 2 comprises a central shaft 3. A lower part of the shaft 3 is internally screw-threaded for attachment to a backhead assembly 4 of the hammer 2. The attachment 1 further comprises a locking sub 9, which is internally screw-threaded at a lower part thereof for attachment to the upper end of the shaft 3. An upper part of the locking sub 9 is externally screw-threaded for attachment to a drill rod 10. The central shaft 3 and the locking sub 9 define a central bore 16 for supply of pressurised air to the hammer 2.

A sleeve 5, hereinafter referred to as a digout sleeve, is co-axially slidably mounted on the shaft 3 and is prevented from rotational movement by means of a splined coupling 6 with the shaft. The sleeve 5 is provided with an external annular shoulder 7 at an upper end thereof, hereinafter referred to as a restriction shoulder. The restriction shoulder 7 is provided with tungsten carbide inserts 11. The digout sleeve is slidable between a closed position as shown in FIG. 1, in which an angled face 8 adjacent the shoulder 7 is seated against a lower end 12 of the locking sub 9, and an open position shown in FIG. 2, in which a lower end 13 of the digout sleeve 5 abuts an external shoulder 14 provided on the central shaft 3. The digout sleeve is further formed with an internal annular shoulder or pressure face 17 at an upper part thereof. The pressure face 17 is downward facing. A chamber 18 is defined between the sleeve 5 and the shaft 3, with the internal face 17 defining the upper end of the chamber 18.

The central shaft 3 is formed with a plurality of ports 19 such that the chamber 18 is in fluid communication with the central bore 16. A further plurality of dogleg ports 20 is provided between the chamber 18 and the splined portion 6 of the shaft.

A piston 15 is mounted for reciprocal movement within the chamber 18 to strike the internal face 17 of digout sleeve 5 to impart a percussive force to the sleeve. The piston has an upper annular face 22 and a lower annular face 24. The piston is provided with a first plurality of channels 21 extending between the upper face 22 and a lower part of the piston inner surface. The piston is also provided with a second plurality of channels 23 extending between the lower face 24 and an upper part of the piston inner surface.

Under normal operating conditions, the digout sleeve 5 is maintained in the closed position shown in FIG. 1 by the piston 15. The piston is forced against the internal face 17 of the sleeve 5 by the pressurised air supplied to chamber 18 through ports 19. This in turn forces the sleeve upwards to seat the angled face 8 against the lower end 12 of the locking sub. In this position, the hammer operates as normal. No air is flushed from the digout sleeve and so the efficiency of the hammer is not affected.

If a restriction is encountered when the hammer is to be withdrawn from the drilled hole, the sleeve 5 slides down against the upward force provided by the piston 15 as shown in FIG. 2. This moves the piston 15 into an active position in which it begins to cycle. Pressurised air from the central bore 16 is supplied through ports 19 alternately into channels 21 and 23 as shown in FIGS. 2 and 3. In the first part of the cycle, as shown in FIG. 2, pressurised air is supplied through ports 19 into channels 21 and into upper portion 25 of the chamber adjacent internal shoulder 17. Simultaneously, air exhausts through channels 23 and ports 20 and flushes through the splined coupling 6. As a result, the piston moves downwards to the "top of stroke" position shown in FIG. 3. In the second part of the cycle, shown in FIG. 3, air exhausts from chamber 25 through channels 21 and ports 20, through the splined coupling 6. Pressurised air is supplied through ports 19 into channels 23, causing the piston to move upwards to the strike position shown in FIG. 2. This reciprocal motion of the piston in turn causes the restriction shoulder 7 of the digout sleeve 5 to hammer upwards through the restriction.

The attachment described above has the advantage of only being deployed when a restriction is encountered. During normal operation of the hammer, the digout sleeve is held in the closed position and no air is flushed. When a restriction is encountered, the attachment deploys automatically to hammer through the restriction, ensuring retrieval of the hammer from the drilled hole.

Referring to FIGS. 6 to 9, a second embodiment of an attachment 101 for a percussion drill tool 102 comprises a central shaft 103. A lower part of the shaft 103 is internally screw-threaded for attachment to a backhead assembly 104 of the hammer 102. The attachment 101 further comprises a locking sub 109, which is internally screw-threaded at a lower part thereof for attachment to the upper end of the shaft 103. An upper part of the locking sub 109 is externally screw-threaded for attachment to a drill rod 110. The central shaft 103 and the locking sub 109 comprise a central bore 116 for supply of pressurised air to the hammer 102.

Figure 6:
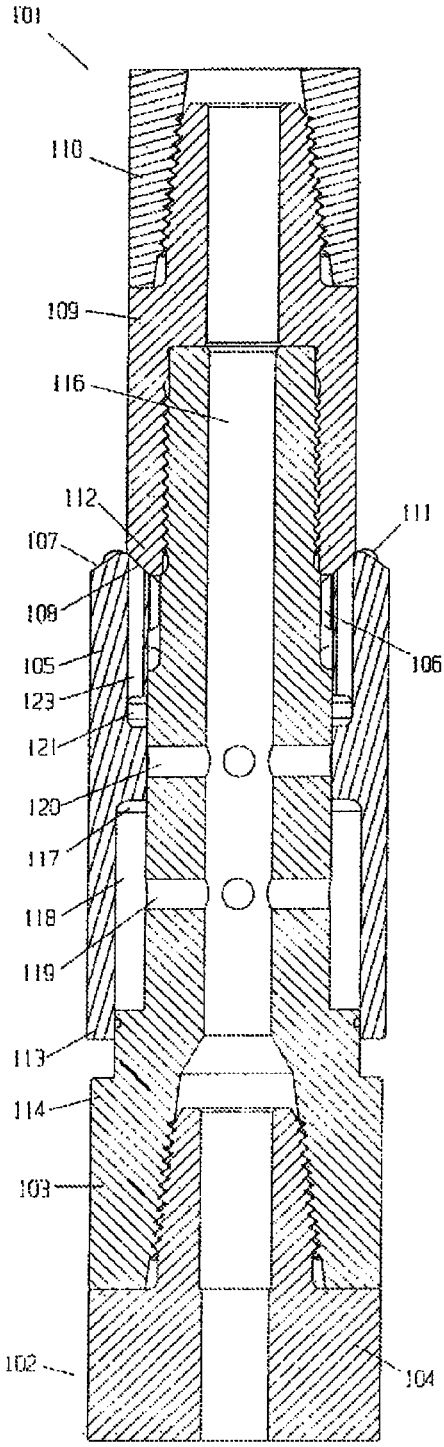
FIG. 6 is a sectional side elevation of an attachment according to a second embodiment of the present invention on a down-the-hole hammer, showing the position of the sleeve when no restriction is present.

A digout sleeve 105 is co-axially slidably mounted on the shaft 103 and is prevented from rotational movement by means of a splined coupling 106 with the shaft. The sleeve 105 is provided with an external annular restriction shoulder 107 at an upper end thereof. The restriction shoulder 107 is provided with tungsten carbide inserts 111. The digout sleeve is slidable between a closed position as shown in FIG. 6, in which an angled face 108 adjacent the shoulder 107 is seated against a lower end 112 of the locking sub 109, and an open position shown in FIG. 7, in which a lower end 113 of the digout sleeve 105 abuts an external shoulder 114 provided on the central shaft 103. The digout sleeve is further formed with an internal annular shoulder 117 such that a chamber 118 is provided between the sleeve 105 and the shaft 103. The digout sleeve 105 is provided with an internal circumferential groove 121 above the annular shoulder 117. A plurality of channels 123 extend between the groove 121 and the angled face 108.

The central shaft 103 is formed with a first plurality of ports 119 such that the chamber 118 is in fluid communication with the central bore 116. A further plurality of ports 120 is provided above the chamber 118.

Under normal operating conditions, the digout sleeve 105 is maintained in the closed position shown in FIG. 6. The digout sleeve is forced upwards to seat the angled face 108 against the lower end 112 of the locking sub by the pressurised air supplied to chamber 118 through ports 119 acting on the internal shoulder 117. Ports 120 are sealed by the internal wall of the digout sleeve 105. In this position, the hammer operates as normal. No air is flushed from the digout sleeve and so the efficiency of the hammer is not affected.

Figure 7:
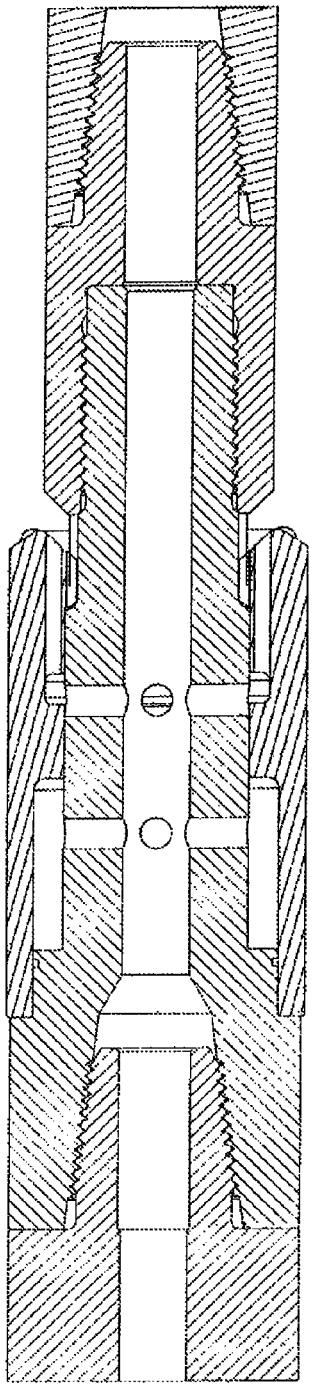
FIG. 7 is a sectional side elevation of the attachment of FIG. 6, showing the sleeve in the open position.
Figure 8:
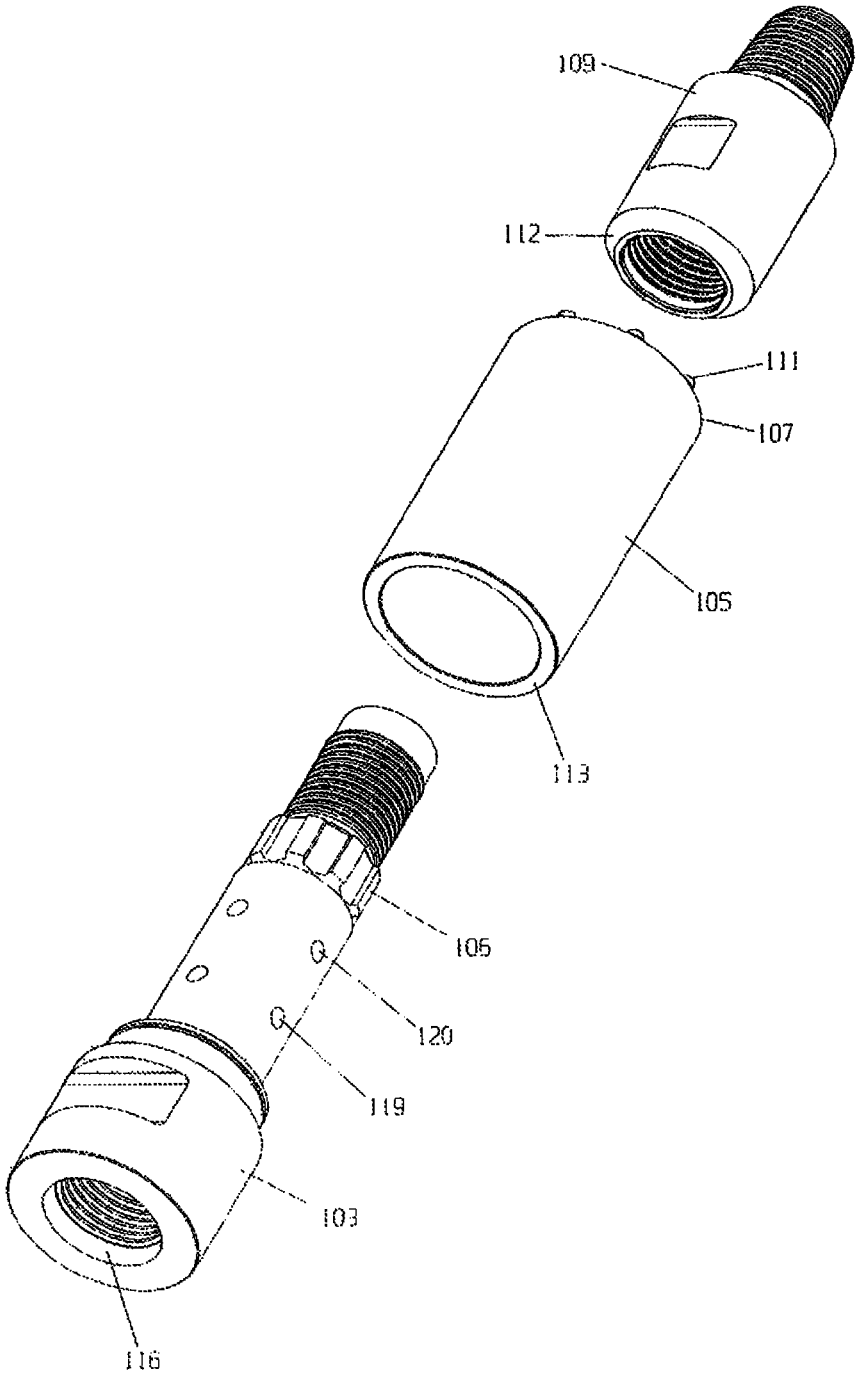
FIG. 8 is an exploded perspective view of the attachment of FIG. 6.
Figure 9:
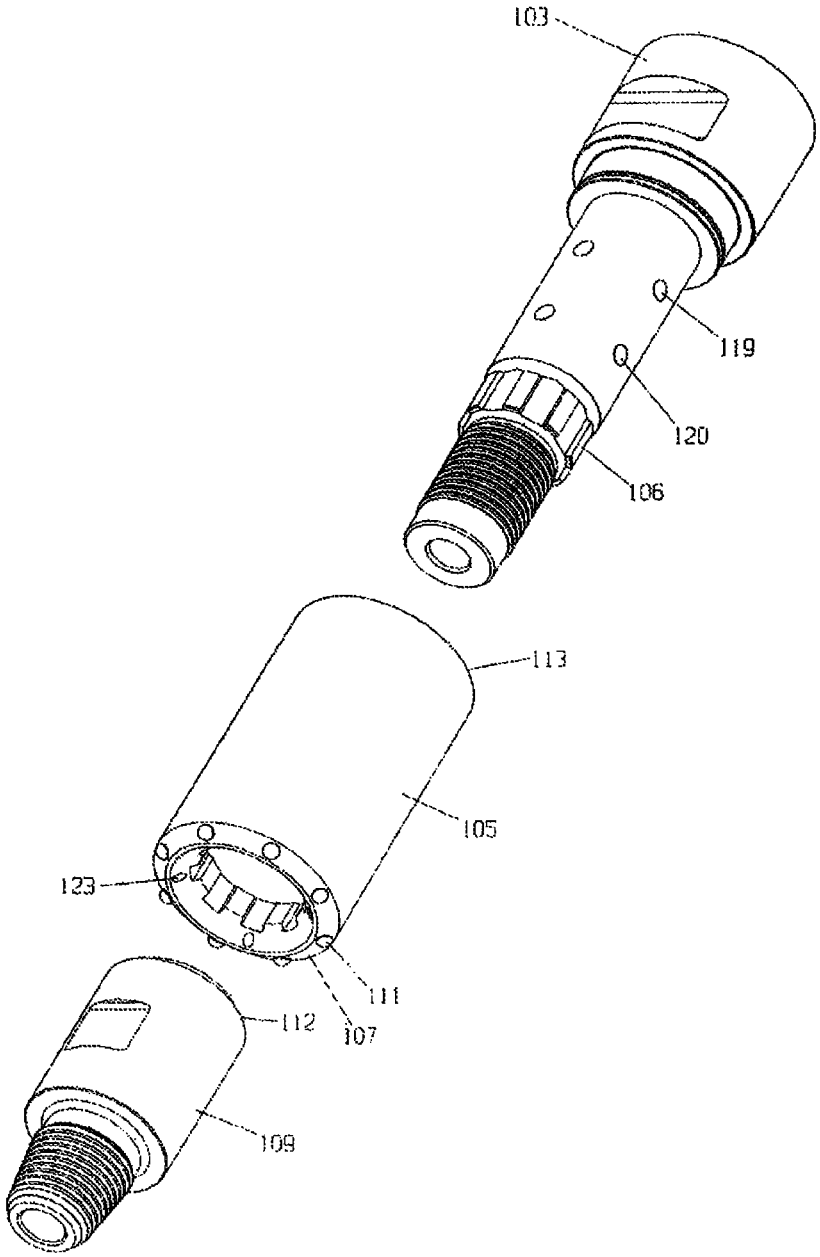
FIG. 9 is an exploded perspective view of the attachment of FIG. 6, from an alternative viewpoint.

If a restriction is encountered when the hammer is to be withdrawn from the drilled hole, the sleeve 105 slides down against the upward force provided by the pressurised air, as shown in FIG. 7. Pressurised air from the central bore 116 is supplied through ports 120 into groove 121 and channels 123 and exhausts adjacent the restriction shoulder 107 to clear the restriction. Simultaneously, pressurised air is supplied through ports 119 into chamber 118 to act on internal shoulder 117. Once the restriction has been cleared (or partially cleared), the digout sleeve 105 will move back to the closed position due to the pressurised air acting on shoulder 117.

As with the previous embodiment, the attachment described above has the advantage of only being deployed when a restriction is encountered. During normal operation of the hammer, the digout sleeve is held in the closed position and no air is flushed. When a restriction is encountered, the attachment deploys automatically to flush air through the restriction, ensuring retrieval of the hammer from the drilled hole.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. An attachment for a fluid-operated percussion drill tool, the drill tool having a backhead assembly for attachment to a drill rod, comprising:

a shaft attachable to the backhead assembly, wherein the shaft comprises a central bore in fluid communication with a pressure bore of the drill rod; and a sleeve co-axially slidably mounted on the shaft, the sleeve comprising an outer shoulder at a rear end thereof; and at least one rearwardly-directed exhaust passage;

such that pressurised air is supplied from the central bore of the shaft to urge the sleeve rearwards into a closed position in which air is prevented from exhausting through the exhaust passage; and when a restriction is encountered at the shoulder, the sleeve moves forward to an open position in which air is permitted to exhaust through the exhaust passage adjacent the restriction.

2. An attachment as claimed in claim 1, wherein, in normal operation, the sleeve is biased towards the closed end position by pressure within the central bore and when a restriction is encountered, the biasing is overcome to force the sleeve into the open flushing position in which air is permitted to exhaust through the exhaust passage adjacent the restriction.

3. An attachment as claimed in claim 1, wherein:

the sleeve further comprises an inner pressure face; and pressurised air is supplied from the central bore of the shaft to act on the inner pressure face to urge the sleeve into the closed position.

4. An attachment as claimed in claim 1, wherein a chamber is defined between the shaft and the sleeve, wherein the inner pressure face defines a rear end of the chamber.

5. An attachment as claimed in claim 4, wherein the chamber is in selective fluid communication with the central bore of the shaft.

6. An attachment as claimed in claim 4, further comprising:

a piston, slidably mounted on the central shaft and arranged for reciprocal movement within the chamber to impart a percussive force to the inner pressure face of the sleeve, wherein the percussive force is in a rearward direction.

7. An attachment as claimed in claim 6, wherein the piston is arranged in the chamber such that pressurised air supplied from the central bore acts on the piston to urge the piston against the inner pressure face of the sleeve.

8. An attachment as claimed in claim 6, wherein the piston comprises a plurality of ports therethrough and when the sleeve moves to the open position, air supplied from the central bore flows through at least one port in the piston to cause the reciprocal movement of the piston within the chamber.

9. An attachment as claimed in claim 8, wherein the piston comprises a first plurality of ports and a second plurality of ports therethrough and when the sleeve moves to the open position, the first and second pluralities of ports are alternately in fluid communication with the central bore to cause the reciprocal movement of the piston within the chamber.

10. An attachment as claimed in claim 1, further comprising:

at least one air supply port in the shaft, the air supply port connecting the central bore with the chamber.

11. An attachment as claimed in claim 1, further comprising:

at least one exhaust port in the shaft;

such that when the sleeve moves to the open position air is permitted to exhaust through the exhaust port and the exhaust passage.

12. An attachment as claimed in claim 11, wherein:

the exhaust passage is provided in the sleeve; and the exhaust port connects the central bore with a lower end of the exhaust passage when the sleeve is in the open position to permit air to exhaust through the exhaust port and the exhaust passage.

13. An attachment as claimed in claim 11, wherein:

a chamber is defined between the shaft and the sleeve;

the exhaust passage is provided between the sleeve and the shaft; and the exhaust port connects the chamber with the exhaust passage when the sleeve is in the open position to permit air to exhaust through the exhaust port and the exhaust passage.

14. An attachment as claimed in claim 1, wherein the shaft is screw-threadably attachable at a lower end thereof to the backhead assembly of the drill tool.

15. An attachment as claimed in claim 1, further comprising a locking sub screw-threadably attached to the shaft at an upper end thereof, wherein the locking sub is attachable at an upper end thereof to a drill rod.

16. An attachment as claimed in claim 15, wherein in the closed position, an upper end of the sleeve is seated against a lower end of the locking sub.

17. An attachment as claimed in claim 1, further comprising a splined coupling between the shaft and the sleeve, such that the sleeve is prevented from rotating relative to the shaft.

18. A down-the-hole hammer comprising:

a backhead assembly; and an attachment comprising:

a shaft attachable to the backhead assembly, wherein the shaft comprises a central bore in fluid communication with a pressure bore of the drill rod; and a sleeve co-axially slidably mounted on the shaft, the sleeve comprising an outer shoulder at a rear end thereof; and at least one rearwardly-directed exhaust passage;

such that pressurised air is supplied from the central bore of the shaft to urge the sleeve rearwards into a closed position in which air is prevented from exhausting through the exhaust passage; and when a restriction is encountered at the shoulder, the sleeve moves forward to an open position in which air is permitted to exhaust through the exhaust passage adjacent the restriction, wherein the attachment is attached at a forward end thereof to the backhead assembly.

19. A percussion hammer for enlarging drilled holes comprising:

a backhead locking member; and an attachment comprising:

a shaft attachable to the backhead assembly, wherein the shaft comprises a central bore in fluid communication with a pressure bore of the drill rod; and a sleeve co-axially slidably mounted on the shaft, the sleeve comprising an outer shoulder at a rear end thereof; and at least one rearwardly-directed exhaust passage;

such that pressurised air is supplied from the central bore of the shaft to urge the sleeve rearwards into a closed position in which air is prevented from exhausting through the exhaust passage; and when a restriction is encountered at the shoulder, the sleeve moves forward to an open position in which air is permitted to exhaust through the exhaust passage adjacent the restriction, wherein the attachment is attached at a forward end thereof to the backhead locking member.

* * * * *